US005558050A

United States Patent [19]

Paro

[11] Patent Number: 5,558,050

[45] Date of Patent: Sep. 24, 1996

[54] ARRANGEMENT FOR THE CONTROL OF VALVE TIMING IN A COMBUSTION ENGINE

[75] Inventor: Daniel Paro, Kvevlax, Finland

[73] Assignee: Wartsila Diesel International Ltd Oy, Helsinki, Finland

[21] Appl. No.: 455,294

[22] Filed: May 31, 1995

[30] Foreign Application Priority Data

Jul. 1, 1994 [FI] Finland ..... 943159

[51] Int. Cl.[6] ..... F01L 1/34; F01L 9/02

[52] U.S. Cl. ..... 123/90.13; 123/90.16; 123/90.22

[58] Field of Search ..... 123/90.12, 90.13, 123/90.14, 90.15, 90.16, 90.22, 90.23

[56] References Cited

U.S. PATENT DOCUMENTS

| | | | |
|---|---|---|---|
| 2,829,628 | 4/1958 | Smiltneek | 123/90.12 |
| 3,139,077 | 6/1964 | Beucher | 123/90.12 |
| 4,258,672 | 3/1981 | Hietikko | 123/90.12 |
| 4,469,056 | 9/1984 | Tourtelot, Jr. et al. | 123/90.16 |
| 4,799,462 | 1/1989 | Tittizer et al. | 123/90.12 |
| 4,848,285 | 7/1989 | Konno | 123/90.16 |
| 5,002,022 | 3/1991 | Perr | 123/90.16 |
| 5,197,419 | 3/1993 | Dingess | 123/90.13 |

FOREIGN PATENT DOCUMENTS

| | | | |
|---|---|---|---|
| 1378676 | 1/1964 | France . | |
| 2504190 | 10/1982 | France . | |
| 803839 | 4/1951 | Germany | 123/90.12 |
| 1002563 | 2/1957 | Germany | 123/90.13 |
| 3825567 | 2/1990 | Germany . | |
| 4338080 | 5/1995 | Germany . | |
| 404426 | 1/1934 | United Kingdom | 123/90.13 |

*Primary Examiner*—Weilun Lo
*Attorney, Agent, or Firm*—Smith-Hill and Bedell

[57] ABSTRACT

The invention relates to arrangement for controlling valve timing in a combustion engine, especially in a large diesel engine with several cylinders, in which the control of a valve (11) in a cylinder is carried out through a follower member (3,4), preferably a roll follower, receiving its guidance from a cam race (2*a*) of a camshaft (2) or the like. There are at least two follower members (3,4) per controlled valve (11), said follower members (3,4) being functionally independent from each other and arranged in cooperation with the same cam race (2*a*) so that their control effect on the valve (11) is different. Only one follower member (3,4) is at a time in force transmission connection with the valve (11) in the cylinder. In addition the arrangement includes means (7) for selecting the follower member (3,4) to be used in each case so that the control of the valve (11) corresponds as well as possible to the operating conditions of the engine in each case.

7 Claims, 2 Drawing Sheets

ARRANGEMENT FOR THE CONTROL OF VALVE TIMING IN A COMBUSTION ENGINE

BACKGROUND OF THE INVENTION

This invention relates to an arrangement for the control of valve timing in a combustion engine, especially in a large diesel engine with several cylinders, in which the control of a valve in a cylinder is carried out through a follower member, preferably a roll follower, receiving its guidance from an outer cam surface or cam race of a camshaft or the like.

As used in this specification, the term "large engine" means an engine such as may be employed for example as a main or auxiliary engine in a ship or in a power plant for production of heat and/or electricity.

Changing of the opening and closing times of exhaust valves in a diesel engine at varying running conditions has an advantageous effect on the operation of the engine. By controlling the timing of the valves lower consumption rates of fuel can be achieved and the concentration of harmful emissions in the exhaust gases of the engine can be lowered. Changing of timing may, if necessary, be applied to intake valves as well. It must be possible to exercise control while the engine is running.

Changing the valve timing in accordance with the prior art has been accomplished for example by using two separate camshafts provided with separate follower members, or by using two different cam races on the same camshaft. In the latter case, each cam race may have a follower member of its own or a single follower member may select one or other cam race by axial movement of the follower member. Furthermore, according to the prior art, various mechanical lever arrangements and eccentric shafts have been used. Also it is known to change the rotational position of the camshaft relative to the crankshaft and divide and move cam segments.

Most of these solutions have in common a rather complicated construction resulting in substantial extra costs. The extra members and structures needed for the change of timing also require space.

SUMMARY OF THE INVENTION

An aim of the invention is to achieve a new solution that has an uncomplicated construction and is advantageous as to costs, providing an easy and quick change of the valve timing so as to comply with the changed running conditions.

According to the invention, there are at least two follower members per controlled valve, said follower members being functionally independent from each other and arranged in cooperation with the same cam race so that functionally they are mutually independent and their control effect on the valve is different. Only one follower member at a time is effective to control operation of the valve of the cylinder. Additionally, there are means for selecting the follower member that is to be used in each case so that the control of the valve corresponds as well as possible to the operating conditions of the engine in each case. The change of the valve timing is, thus, carried out simply by selecting either one of the follower members for use depending on the situation.

An advantageous solution from the viewpoint of space requirements can be achieved when the follower members of the valve are arranged in the direction of the rotational movement of the camshaft immediately in succession so that their mutual angular difference relative to the rotation of the camshaft corresponds to the desired change in the timing of the valve.

In practice, an advantageous selection solution for the follower member is achieved if the force transmission from the follower member to the valve is arranged at least partly hydraulically. In that case, the arrangement includes a hydraulic valve having a movable valve element that is movable between a connecting position and a disconnecting position for the force transmission connection of the selected follower member to the valve in the cylinder.

The hydraulic valve is advantageously a three way valve including a valve element that is turnable between two operative positions. In the different operative positions of the valve element, the three way valve connects the force transmission member of the valve in the cylinder to hydraulic ducts of the different follower members respectively. In this case, the member whose force transmission connection is disconnected is advantageously connected to a hydraulic fluid container. For this purpose, the hydraulic valve includes a chamber which connects the hydraulic duct of one of the follower members to the hydraulic fluid container when the hydraulic duct of the other follower member is connected to the force transmission member of the valve in the cylinder.

Two or more follower member pairs may be arranged in cooperation with the same cam race for the control of several valves. The solution is suitable for use especially in a gas diesel engine employed for power plant use, whereby for example the conventional camshaft of an engine may be replaced by a separate shaft including a cam race that controls several valves simultaneously.

BRIEF DESCRIPTION OF THE DRAWINGS

The invention will now be further described, by way of example, with reference to the accompanying drawings, in which.

DETAILED DESCRIPTION

Figure 1:
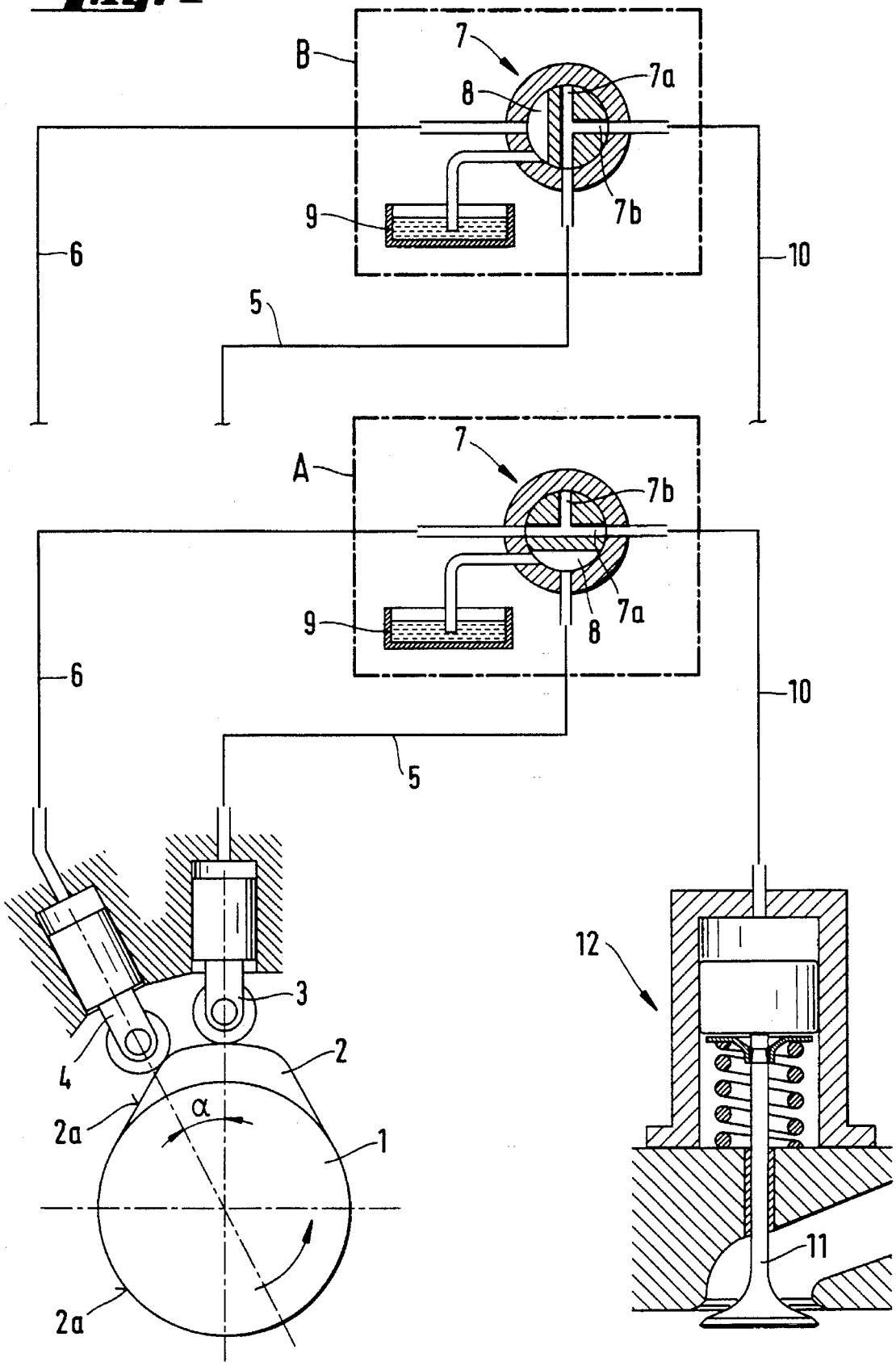
FIG. 1 shows schematically a first arrangement according to the invention.

In the drawings, 1 indicates a camshaft or similar rotatable shaft of an engine with a cam 2 which together with a jacket portion of the camshaft at the corresponding location forms a continuous cam race 2*a* encircling the camshaft. The arrangement includes also roll followers 3 and 4 which follow the cam race 2*a* when the camshaft is rotating. The roll followers 3 and 4 are arranged at an angular distance a from each other and, hence, they are located in slightly different places along the cam race 2*a*.

In the embodiment shown, the roll followers 3 and 4 operate hydraulically and each is equipped with a hydraulic piston that moves in a hydraulic chamber (details not shown in figures). The hydraulic chambers are connected by means of hydraulic ducts 5 and 6 to respective ports of a three way valve 7 included in the selection arrangement for the roll follower, and therefrom further via a duct 10 to guiding and operating means 12 of a valve 11 that is associated with a cylinder of a combustion engine. The three way valve 7 includes a rotatable valve element that is formed with ducts 7*a* and 7*b*, by means of which either the duct 5 or the duct 6 may be connected to the duct 10 by turning the valve element. In this way, one of the roll followers 3 or 4 is switched to force transmission connection with the valve 11 and the other roll follower is connected via a chamber 8 in the three way valve 7 to a hydraulic fluid container 9. These two different connection situations are illustrated in FIG. 1 with partial figures A and B.

For the control of the turning movement of the three way valve 7 in practice, controls means and logic means are also needed (not shown in figures) which on the basis of given boundary limits make a selection of the correct roll follower 3 or 4 by turning the valve element of the three way valve 7 to the position in which it places the proper roll follower in force transmission connection with the valve 11.

When desired, the invention may be applied also so that during the same cylinder stroke, both the roll followers 3 and 4 are used in turn for achieving as long or alternatively as short open time period as possible for the valve 11.

The embodiment shown in FIG. 1 is thus based on a hydraulic force transmission, whereby the hydraulic fluid acts directly between the hydraulic piston of the roll follower 3 or 4 and the guiding and operating means 12 of the valve 11. The arrangement may alternatively be only partly hydraulically operated so that the force transmission from the duct 10 to the valve 11 is effected through a lever arrangement.

Further, the force transmission from the selected roll follower 3 or 4 to the valve 11 may generally be arranged in many different ways. For example, the force transmission may be entirely mechanical, but in this case a selection mechanism is needed for ensuring that only one of the roll followers is in force transmission connection with the valve 11 at any time.

It is also possible that the roll followers 3 and 4 are not at all in force transmission connection with the valve 11. In this case, a control impulse generated by the selected roll follower is transformed into an electrical impulse that in turn is arranged to control the valve 11 according to separate operating devices. For example, an electrically controlled solenoid valve may be used for the purpose.

Figure 2:
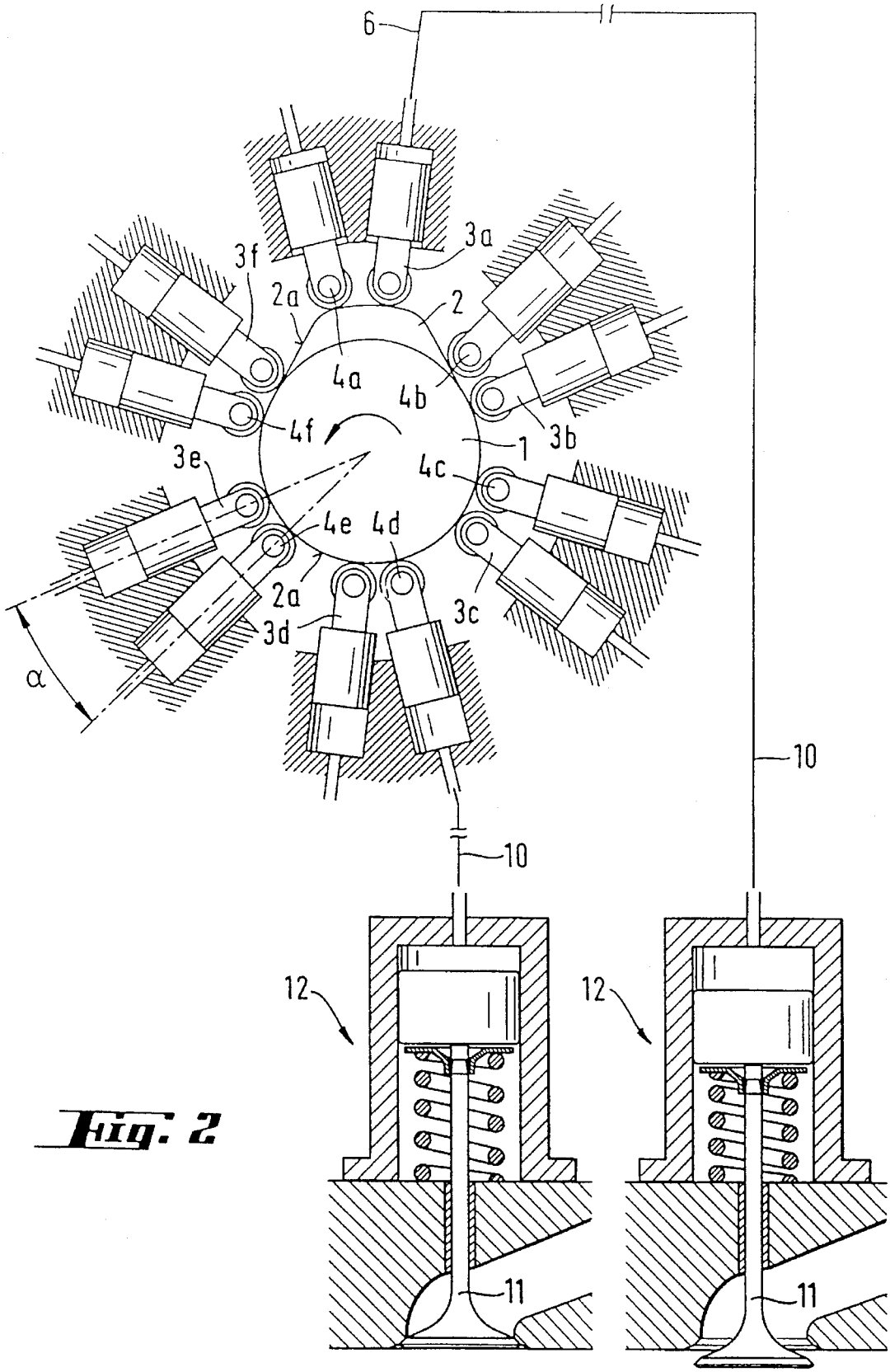
FIG. 2 shows schematically a second arrangement according to the invention, based on a development of the arrangement shown in FIG. 1.

FIG. 2 illustrates a modification of the version of FIG. 1, whereby two or several follower member pairs 3*a*–3*f* and 4*a*–4*f* are arranged in cooperation with the same cam race 2*a* for the control of several valves 11. This kind of solution is suitable for use especially in an engine employed for power plant use.

The invention is not restricted to the embodiments shown, but several modifications are feasible within the scope of the attached claims.

I claim:

1. An arrangement for controlling valve timing in a combustion engine having at least one engine valve associated with a cylinder of the engine and a rotary shaft having an outer cam surface extending therearound, said arrangement comprising at least first and second follower members that are functionally independent of each other and cooperate with the outer cam surface, and selectively operable coupling means effective between said follower members and said valve, the coupling means having at least a first state in which the first follower member controls the valve and a second state in which the second follower member controls the valve.

2. An arrangement according to claim 1, wherein the rotary shaft has an axis of rotation and the first and second follower members are angularly spaced about the axis of rotation of the rotary shaft, and wherein the angular spacing of the follower members effects a change in timing of the valve in the event that the coupling means change from the first state to the second state or vice versa.

3. An arrangement according to claim 1, wherein the coupling means comprise a hydraulic valve, and in the first state of the coupling means the hydraulic valve selects the first follower member and in the second state of the coupling means, the hydraulic valve selects the second follower member.

4. An arrangement according to claim 3, wherein the coupling means comprise a first hydraulic driver that converts movement of the first follower member to change in pressure of hydraulic fluid at a first port of the hydraulic valve, a second hydraulic driver that converts movement of the second follower member to change in pressure of hydraulic fluid at a second port of the valve, and a hydraulic receiver that converts change in hydraulic pressure at a third port of the hydraulic valve to movement of the engine valve, and wherein in the first state of the coupling means the hydraulic valve connects the first port to the third port, and in the second state of the coupling means the hydraulic valve connects the second port to the third port.

5. An arrangement according to claim 4, further comprising a hydraulic fluid container and wherein in the first state of the coupling means the hydraulic valve connects the second port to the hydraulic fluid container, and in the second state of the coupling means the hydraulic valve connects the first port to the hydraulic fluid container.

6. An arrangement according to claim 1, wherein in the first state of the coupling means the first follower member is in force transmission connection with the valve and in the second state of the coupling means the second follower member is in force transmission connection with the valve.

7. An arrangement for controlling valve timing in a combustion engine having at least two engine valves and a rotary shaft having an outer cam surface extending therearound, said arrangement comprising at least first and second follower members associated with each valve, said follower members being functionally independent of each other and cooperating with the outer cam surface, and selectively operable coupling means effective between the first and second follower members and the associated valve, the coupling means having at least a first state in which the first follower member controls the associated valve and a second state in which the second follower member controls the associated valve.

* * * * *